US012135149B2

(12) United States Patent
Lantz

(10) Patent No.: US 12,135,149 B2
(45) Date of Patent: Nov. 5, 2024

(54) HEATING AND REFRIGERATION SYSTEM

(71) Applicant: Illuminated Extractors, Ltd., Fort Collins, CO (US)

(72) Inventor: Zachary Richard Lantz, Laporte, CO (US)

(73) Assignee: Illuminated Extractors, Ltd., Fort Collins, CO (US)

( * ) Notice: Subject to any disclaimer, the term of this patent is extended or adjusted under 35 U.S.C. 154(b) by 171 days.

(21) Appl. No.: 17/508,937

(22) Filed: Oct. 22, 2021

(65) Prior Publication Data

US 2022/0128272 A1 Apr. 28, 2022

Related U.S. Application Data

(60) Provisional application No. 63/104,650, filed on Oct. 23, 2020.

(51) Int. Cl.
*F25B 40/02* (2006.01)
*F25B 1/10* (2006.01)
(Continued)

(52) U.S. Cl.
CPC ..... *F25B 1/10* (2013.01); *F25B 39/02* (2013.01); *F25B 39/04* (2013.01); *F25B 40/02* (2013.01);
(Continued)

(58) Field of Classification Search
CPC ..... F25B 1/10; F25B 41/22; F25B 39/02; F25B 39/04; F25B 40/00; F25B 40/02; F25B 40/06; F25B 2400/23; F28D 1/0461
See application file for complete search history.

(56) References Cited

U.S. PATENT DOCUMENTS 4,807,449 A * 2/1989 Helmer ..... F25B 40/00 62/509
5,537,836 A * 7/1996 Ricketts ..... F25B 45/00 62/149
(Continued)

FOREIGN PATENT DOCUMENTS

EP 4116639 A1 * 1/2023
WO WO-2004079279 A2 * 9/2004 ..... F25B 40/00
(Continued)

OTHER PUBLICATIONS

Escudier, M., & Atkins, T. (2019). fittings. In A Dictionary of Mechanical Engineering. : Oxford University Press. Retrieved May 16, 2024, from https://www.oxfordreference.com/view/10.1093/acref/9780198832102.001.0001/acref-9780198832102-e-2216. (Year: 2019).*

*Primary Examiner* — Miguel A Diaz
(74) *Attorney, Agent, or Firm* — Samuel M. Freund; Cochran Freund & Young LLC

(57) ABSTRACT

Apparatus and method for heating and cooling a refrigerant are described. The refrigerant, which may be contained in the core of a jacketed container, is cooled by depressurization and evaporation of a portion of the refrigerant also contained in the jacket of the container. The vapor resulting from the evaporation is directed to the inlet of a compressor for pressurizing the vapor, which is then passed through a condenser where heat is removed causing the high-pressure refrigerant vapor to transition to hot vapor, warm liquid, and cold vapor. Heat generated by compression of the hydrocarbon refrigerant vapor to a state of super-heated vapor may be directed to the jacket of a vessel requiring heating.

18 Claims, 5 Drawing Sheets

(51) Int. Cl.

| | |
|---|---|
| ***F25B 39/02*** | (2006.01) |
| ***F25B 39/04*** | (2006.01) |
| ***F25B 40/06*** | (2006.01) |
| ***F25B 41/22*** | (2021.01) |

(52) U.S. Cl.
CPC ..... *F25B 40/06* (2013.01); *F25B 41/22* (2021.01); *F25B 2400/23* (2013.01)

(56) References Cited

U.S. PATENT DOCUMENTS 5,692,394 A * 12/1997 Ozaki ..... F25B 13/00 62/509
11,885,540 B2 * 1/2024 Rahhal ..... F28D 7/0091
2003/0000245 A1 * 1/2003 Guckin ..... F25B 40/00 62/513
2011/0005256 A1 * 1/2011 Terry ..... F24F 3/14 62/259.1
2015/0143836 A1 * 5/2015 Junge ..... F25B 5/02 62/474
2016/0054033 A1 * 2/2016 Matsuura ..... F25B 41/28 62/498
2017/0176064 A1 * 6/2017 Schreiber ..... F28D 5/02
2017/0176066 A1 * 6/2017 Schreiber ..... F28D 7/1607
2017/0176077 A1 * 6/2017 Knatt ..... F25C 1/12
2019/0316818 A1 * 10/2019 Spangler ..... F25B 31/004
2022/0205691 A1 * 6/2022 Spangler ..... F25B 31/004
2023/0349604 A1 * 11/2023 Papoulis ..... F28D 9/0006
2024/0167738 A1 * 5/2024 Woolf ..... F25B 39/02

FOREIGN PATENT DOCUMENTS

WO WO-2011147954 A2 * 12/2011 ..... D06F 43/08
WO WO-2015000044 A1 * 1/2015 ..... F25B 40/02

* cited by examiner

HEATING AND REFRIGERATION SYSTEM

CROSS-REFERENCE TO RELATED APPLICATIONS

The present application claims the benefit of U.S. Provisional Patent Application No. 63/104,650 for "Thermal Control System For Extraction Processes" which was filed on 23 Oct. 2020, the entire content of which Patent Application is hereby specifically incorporated by reference herein for all that it discloses and teaches.

BACKGROUND

Existing multi-stage refrigeration systems utilize multiple compressors and evaporators, with each stage employing a refrigerant having a lower boiling point, in a stage-cooling process for condensing and cooling the initial refrigerant. As an example, a refrigeration system using propane as a refrigerant could be used to cool an ammonia refrigerant, which can then be used to cool natural gas. These refrigeration systems are often placed out-of-doors, because of the volume of refrigerant employed. When used indoors, fire regulations limit the quantity of flammable refrigerant to less than 500 lbs., which must be accompanied by fire suppression, gas detection, and gas exhaust systems, as basic equipment. Further, all electrical devices must be switched on and off using remote shunt switches to avoid sparks.

Use of carbon dioxide requires large quantities of the liquid, and use in enclosed areas requires $CO_2$ gas detection devices and alarms. The vapor pressure of liquid $CO_2$ requires high-pressure capable piping since the vapor pressure of $CO_2$ at room temperature (20° C.) is 826 psi. Liquid nitrogen can also be used for cooling, but cost and handling procedures make it prohibitive on a large scale.

SUMMARY

In accordance with the purposes of embodiments of the present invention, as embodied and broadly described herein, the device heating and cooling system, hereof, includes: a compressor for generating superheated vapor from a refrigerant; a condenser for receiving superheated vapor, for removing heat from the superheated vapor, and for generating a liquid refrigerant therefrom; and at least one sub-cooler, including: a first chamber having a first outer surface, a top and a bottom, enclosing a core volume; a second chamber surrounding the first outer surface of the first chamber having a second outer surface, a top and a bottom, forming a second volume; a first valve for filling the second volume with refrigerant from the core volume; and a first manifold for directing cooled refrigerant in the core volume to devices to be cooled.

In another aspect of embodiments of the present invention, and in accordance with their purposes, an embodiment of the method for heating and cooling devices, hereof, includes: generating superheated vapor by compressing a refrigerant; removing heat from the superheated vapor, whereby a liquid refrigerant is generated therefrom; and filling the core volume of a chamber with liquid refrigerant; filling a second volume of the chamber surrounding the core volume and in thermal communication therewith with liquid refrigerant; vaporizing the liquid refrigerant in the second volume of the chamber into the inlet of a compressor, whereby the refrigerant in the core volume is cooled; and directing cooled refrigerant in the core volume to devices to be cooled.

Benefits and advantages of the present invention include, but are not limited to, providing an apparatus and method for heating and cooling devices where it has been confirmed that the system uses less power the lower the pressure becomes and the colder the system gets. Further, by reintroducing refrigerant at or near the temperature of evaporation, the operating pressure does not increase upon injection of liquid into the second evaporator, and therefore does not increase the amount of work performed by the compressor.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
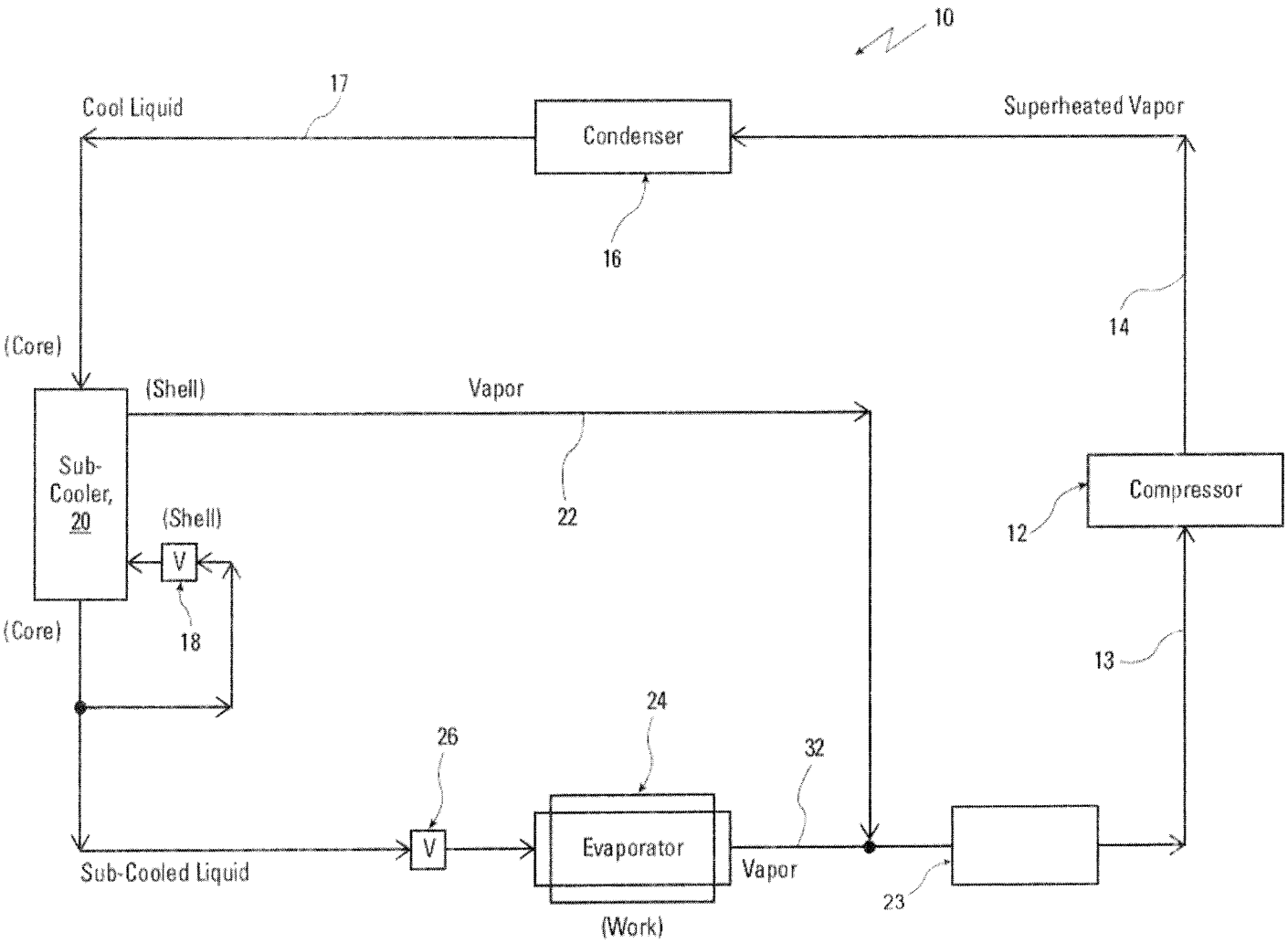
FIG. 1 is a schematic representation of a side view of an embodiment of a simplified refrigeration apparatus, where propane is used as the refrigerant. Propane vapor is compressed to a superheated vapor, and directed into a condenser where heat is removed, forming cool propane liquid. An expansion valve is utilized for cooling the core volume of a sub-cooler containing liquid propane, enclosed by a shell, which also contains liquid propane, whereby the propane refrigerant in the core is cooled by expanding the surrounding propane.

Briefly, embodiments of the present invention include apparatus and methods for heating and cooling a refrigerant that may also be used for chemical extractions requiring heating and/or cooling. As examples, suitable refrigerant/solvents are hydrocarbon solvents such as propane, butane, and isobutane, and mixtures thereof, and the chemical extractions may include extraction of cannabinoids. In operation, the refrigerant contained in the core of a jacketed container is cooled by depressurization and evaporation of a portion of the refrigerant contained in the jacket of the container. For improved heat transfer, the jacket may include tubing surrounding the core containing the refrigerant. The vapor resulting from the evaporation is directed to the inlet of a compressor for pressurizing the vapor, which is then passed through a condenser where heat is removed causing the high-pressure refrigerant vapor to transition to hot vapor, warm liquid, and cold vapor. An accumulation of low-pressure vapors, from other vessels being cooled, may also be directed to the compressor, often by first passing through a liquid-vapor separator.

Heat is generated by compression of the hydrocarbon refrigerant vapor to a state of super-heated vapor that can then be directed to the jacket of a vessel requiring heating. Other refrigerants, such as ammonia and freon, can be utilized for this process, but are not as useful as hydrocarbon solvents for chemical extractions. It should be noted that the solvent used for chemical processing, although potentially having the same identity as that utilized in the cooling and heating processes, is not used for both functions in the same apparatus, except in the situation where both functions are not separated. That is, the refrigerant used for heating and cooling can be used to heat and cool the solvent used for chemical processing. As examples, an extraction column, recovery basin, a wiped film evaporator and/or a rising/falling film evaporator may be heated to remove liquid solvent from crude extract material for solvent recovery by vaporization, as well as to raise the solvent temperature during the extraction process for increasing the solubility of the solvent. The refrigerant used for heating and cooling is recirculated, as may the solvent for the chemical processing, but in separate systems.

As stated, traditional multi-stage refrigeration systems utilize multiple compressors and evaporators to stage-cool the initial refrigerant. Embodiments of the present apparatus and method utilize the same hydrocarbon refrigerant for all stages, and one having the same identity as that employed for a chemical extraction process. A second refrigeration system, such as a glycol chiller or ethanol chiller, is therefore not required to cool the solvent by heat exchange prior to use; however, a condenser utilizing a glycol-water heat exchanger has been used to remove the majority of heat from the vapor directly exiting a compressor for condensing the solvent vapor prior to storage, or in preparation for further cooling, if it has not otherwise been consumed in the process.

After exiting the condenser, the liquified solvent still contains significant latent heat, which is removed by further cooling before injecting the liquid into a cooled vessel since the injected liquid would otherwise warm the vessel, thereby creating higher pressure and rendering the system less efficient. Therefore, the injected refrigerant is close to being as cold as the solvent in the vessel being chilled.

Thermal mass is related to the quantity of liquid refrigerant at a given pressure, as opposed to the quantity of vapor moving through the compressor, which tends to be small when the remaining volume of liquid is cold. As the liquid is removed from the jacket of a vessel being chilled in the form of a vapor, fresh liquid must be introduced in order to maintain chilling. Already chilled, fresh refrigerant is injected into the jacket so that the temperature of the refrigerant entering the jacket is close to the current temperature of the jacket. When refrigerant is injected into a low-pressure region already at low temperature, the pressure can be further decreased to achieve further chilling, and the same amount of solvent is used to operate the system, but less energy is required for chilling.

In accordance with embodiments of the present invention, a multi-stage system using the same refrigerant for all stages is employed. Because the solvents used for cannabinoid extraction, typically n-butane, iso-butane, or propane are also refrigerants (R290, R600, R600a), both functions are available, and the refrigerant may also be used as the solvent for the extraction process. Propane, when used at saturation (liquid and vapor in dynamic equilibrium), can attain temperatures as low as a few degrees above it's freezing point at −188° C. (−138° C. for butane). As a result, propane at saturation can be used to cool a warmer refrigerant to a point at which it is being injected at the temperature of operation, whereby the injected liquid maintains the liquid level within the system being cooled. The volume of refrigerant that needs to be at a specified pressure to maintain the desired temperature must be determined, along with the ability of the system to compress the vapor into a high-pressure, super-heated state, which can then lose heat to required heating functions, and ultimately condense into a liquid once past the saturated vapor point, thereby providing on-demand heat as needed.

After the initial condensation stage, a second condenser, defined as the sub-cooling condenser, is used to cool the refrigerant below that temperature obtained in the initial stage, in effect sub-cooling the refrigerant. The refrigerant is caused to flow from either end of a condensed refrigerant storage vessel (the condenser), if employed, into the either end of the sub-cooling condenser, and into the core thereof. The refrigerant exits through an outlet at the bottom of the condenser, where the remaining sub-cooled refrigerant may be directed to vessels that require cooling, such as the extraction columns, a portion of the refrigerant being directed into the volume inside the jacket of the condenser from the tubes forming the core through a valve, thereby permitting the refrigerant to surround the tubes of the sub-cooling condenser. A liquid-vapor separator, or oil separator, may be used to prevent liquid from entering the compressor. The output from the compressor is in fluid communication with a high-pressure vapor supply tube that directs the compressed refrigerant through a pressure differential valve before entering the first condenser, thereby forming a fluid loop, not required for refrigeration, but for heating only.

Refrigerant, after having been introduced into the extraction columns or other vessels being chilled, exits these vessels as a vapor and joins the vapor exiting the cooling jacket of the second and/or any subsequent sub-cooling condensers, before entering the compressor. In the situation where a liquid-vapor separator, or oil separator, is employed, the vapor passes through this apparatus as well. The internal pressure of the vapor within the sub-cooling condenser jacket and the columns being cooled, determine the vapor temperature. Since the vapor is being depressurized as it flows toward the compressor, a saturated liquid-vapor mixture is formed, which lowers the temperature of the remaining liquid and can absorb heat. By using a sub-cooled refrigerant, heat is not added to the work evaporator or sub-cooling columns, and the liquid level therein can be maintained without increasing the pressure in the system. A dedicated back-pressure valve is used to maintain pressure between the compressor outlet held between about 150 psi and about 300 psi, more typically about 250 psi, and the condenser inlet, typically held between about 50 psi and about 200 psi, most typically about 150 psi, when using propane as the refrigerant. This back-pressure zone provides on-demand heat to the columns when the liquid injection and vapor removal valves are closed, and the heat injection valve at the column to be heated or cooled is opened. This generates additional volume to be pressurized over that of the compressor outlet, which heat of compression can then be utilized at individual locations prior to condensing the refrigerant at the condenser once beyond the back-pressure valve, which when condensed and sub-cooled is used for maintaining the column liquid level. The back-pressure valve differential: (a) provides additional heat not otherwise present at the condenser; and (b) the heat from compression of the vapor is provided directly to each system to be heated. When the fluid pathway from the compressor outlet to the condenser inlet flows through each heated station in a series path, the hot vapor from the compressor performs the heating in a loop, since the tubing following the compressor outlet and pre-condenser inlet forms a vessel which is pressurized above that of the condenser, before any heat is removed, which then allows the column pressure to equalize with the compressor outlet pressure, thereby reducing the imbalance of heat provided to each system location. Pressurizable zones are thus formed in the tubing between the compressor outlet and the condenser inlet back-pressure valve by using individual valves, thereby avoiding dead-short conditions. The condenser back-pressure valve provides the pressure differential between the condenser and the compressor outlet, which then provides the on-demand heating capacity while simultaneously providing the on-demand cooling capacity. In accordance with the teachings of embodiments of the present invention, extraction columns can be both heated or cooled such that some may be hot and others cold at the same time.

Heat may also be generated in the columns requiring heat by closing the liquid injection valve and the vapor outlet valve to a column, while opening the hot vapor inlet valve thereto. This allows pressure to build within the head-space contained within the jacket volume, the pressure being related to the temperature within the pressurized volume of liquid within the column; that is, all of the liquid will have the same temperature. The vapor head-space will be slightly super-heated, typically around 1.5° C. to 2.5° C., beyond the saturated vapor point found at the liquid-vapor interface. The head-space receives the super-heat provided by the compressor at the outlet stage along the series path to the back-pressure valve since, without the flow of heated molecules across the volume they are entering, would be principally saturated vapor instead of super-heated vapor, which may become a problem when heating multiple columns within the system, since they are arranged in series with the compressor outlet to the condenser inlet provided that sufficient back-pressure has been achieved.

Embodiments of the present refrigeration system may be operated using a single compressor, which also operates the extraction system, or it can have a dedicated compressor for achieving lower operational temperatures and maximize solvent transfer with the primary transfer compressor. When utilizing a single compressor, the refrigeration process is performed independently of the extraction process, as the required inlet pressure will prevent high volume flow through the compressor. A first column jacket is chilled by the compressor by first filling the column, and subsequently using the compressor to decrease the pressure so that the temperature of the solvent/refrigerant in the jacket auto-refrigerates until the desired temperature is reached. The jacket inlet and outlet valves are then closed and the thermal capacity is provided by the cooled solvent/refrigerant and the cooled container holding the solvent, typically stainless steel, or other metal, or glass. This thermal energy absorbs heat from the system during the extraction process. As the thermal energy is absorbed by incoming solvent, the jacket temperature will increase as internal pressure builds within the jacket. To maintain a single compressor extraction, the extraction process will have to be stopped in order to re-chill the jacket system. Once the desired temperature is restored, extraction may continue, and lost time will be that required for cooling the jacket. It is possible to overcome this if the compressor is over-sized.

In other embodiments, the system may be operated using two compressors; one dedicated to the extraction process, whereby solvent transfer through the system is maximized, thereby speeding extraction; while the other compressor is dedicated to the thermal control system for providing the ability to both warm or cool a column on-demand. Typically, an extraction compressor is operated between about 10 psi and about 100 psi at the inlet, most typically, between about 50 psi and about 100 psi when utilizing propane as the solvent. This will maximize the solvent transferred through the extraction compressor while the thermal control compressor operates independently of the extraction system.

The vapor from either compressor outlet of a two-compressor embodiment (extraction compressor and refrigeration compressor) may be directed into a vessel or device for vaporizing solvent contained therein, such as a collection basin, a wiped/rolled film evaporator, a rising/falling film evaporator, or a centrifugal evaporator, as examples. This allows the heat of compression to be utilized for heating without a secondary heating system. The heat of compression can be utilized for evaporation of the process solvent by utilizing a back-pressure device that allows the compressor outlet to be at a higher pressure than that of the condenser inlet. Vapor which condenses within the system prior to the condenser, thereby reduces the work-load of the condenser upon depressurization into the condenser. The liquid self-cools by means of auto-refrigeration due to the pressure drop between zones. A portion of this liquid is thereby vaporized and becomes the work-load that the compressor must handle.

Reference will now be made in detail to the present embodiments of the invention, examples of which are illustrated in the accompanying drawings. In the Figures, similar structure will be identified using identical reference characters. It will be understood that the FIGURES are presented for the purpose of describing particular embodiments of the invention and are not intended to limit the invention thereto. Turning now to FIG. 1, shown is a schematic representation of a side view of an embodiment of a simplified refrigeration apparatus, 10, illustrating the principal parts of the present apparatus. In what follows, R290 (propane) is typically used as the refrigerant. Compressor, 12, takes vapor, 13, from the remainder of the system and compresses it to superheated vapor, 14, which is directed into condenser, 16, where heat is removed, forming cool propane liquid, 17. Condenser 16 may be cooled using common procedures, such as water or air cooling, or by using other refrigerants to generate cooled propane liquid 17. In its simplest form, embodiments of the present invention utilize two expansion valves, with first expansion valve, 18, and sub-cooler, 20, forming the basis of embodiments of the present refrigeration system. One embodiment of sub-cooler 20 has a core volume for holding liquid propane, enclosed by a shell, which also contains liquid propane. A portion of the total refrigerant in condenser 16 is used to generate a cold zone for heat exchange with the remaining liquid exiting the condenser, by directing the bulk of the refrigerant in the condenser into the core of sub-cooler 20, with the remaining refrigerant being expanded through first expansion valve 18 into the shell volume of sub-cooler 20, where it effectively cools the refrigerant in the core thereof before returning as vapor, 22, to vapor inlet 13 of compressor 12. As stated above, liquid-vapor separator, 23, may be used to prevent liquid from entering compressor 12.

After additional heat is removed, the refrigerant remaining in the core of sub-cooler 20, is directed to evaporator 24, where work can be performed upon refrigerant expansion using second expansion valve, 26. Second evaporator 24 is the primary heat exchanger for external work, whereas sub-cooler 20 removes heat from the remaining liquid refrigerant in condenser 16 before expansion through second expansion valve 26. That is, sub-cooler 20 removes additional enthalpy after refrigerant condensation (16) and prior to entering evaporator 24. This allows the liquid refrigerant to enter the second evaporator at or near the temperature of evaporation. Thus, the liquid level in the second evaporator can be maintained without: (a) introducing heat; or (b) decompressing introduced refrigerant, rendering refrigeration systems capable of operation at approximately 100% efficiency. After performing work, vapor, 32, exiting evaporator 24 may be combined with vapor 22 from sub-cooler 20 to enter the low-pressure inlet 13 of compressor 12.

In operation, the condenser has an open fluid pathway to the core of the sub-cooler, and all liquid exiting the condenser must first pass through the core of the sub cooler before being utilized elsewhere. Once the condensed liquid passes through the core of the sub-cooler, then it can be delivered to the work evaporator or sub-cooler second volume, the jacket or shell. In this manner, the liquid in the jacket is the initial source of cold, which then cools what is in its core. As vapor is removed from the jacket, the liquid level decreases and will eventually need to be replenished. Now that the liquid is cold and the subsequent liquid held in the core is also cold, core liquid is injected into the jacket so as to maintain liquid level. Upon this injection, because the liquid in the core is very close to or at the temperature of the jacket (from previous cooling cycle), very little or no pressure is introduced and its temperature can continue to decrease along with the temperature of the work vessel. At this point, the sub-cooler can maintain its own temperature and also supply liquid of the same temperature to the work evaporator. The second volume maintains a liquid level no different than the work evaporator and should be at least 20% full but preferably closer to 80% full in the outer jacket with liquid sourced from its core. A full sub-cooler can transfer a larger amount of subcooled liquid into the work evaporator or more rapidly to its own jacket, and will be closer to the temperature of evaporation at the work evaporator. In this manner, whenever liquid is refilled to an evaporator, minimal heat is introduced upon injection.

Figure 2:
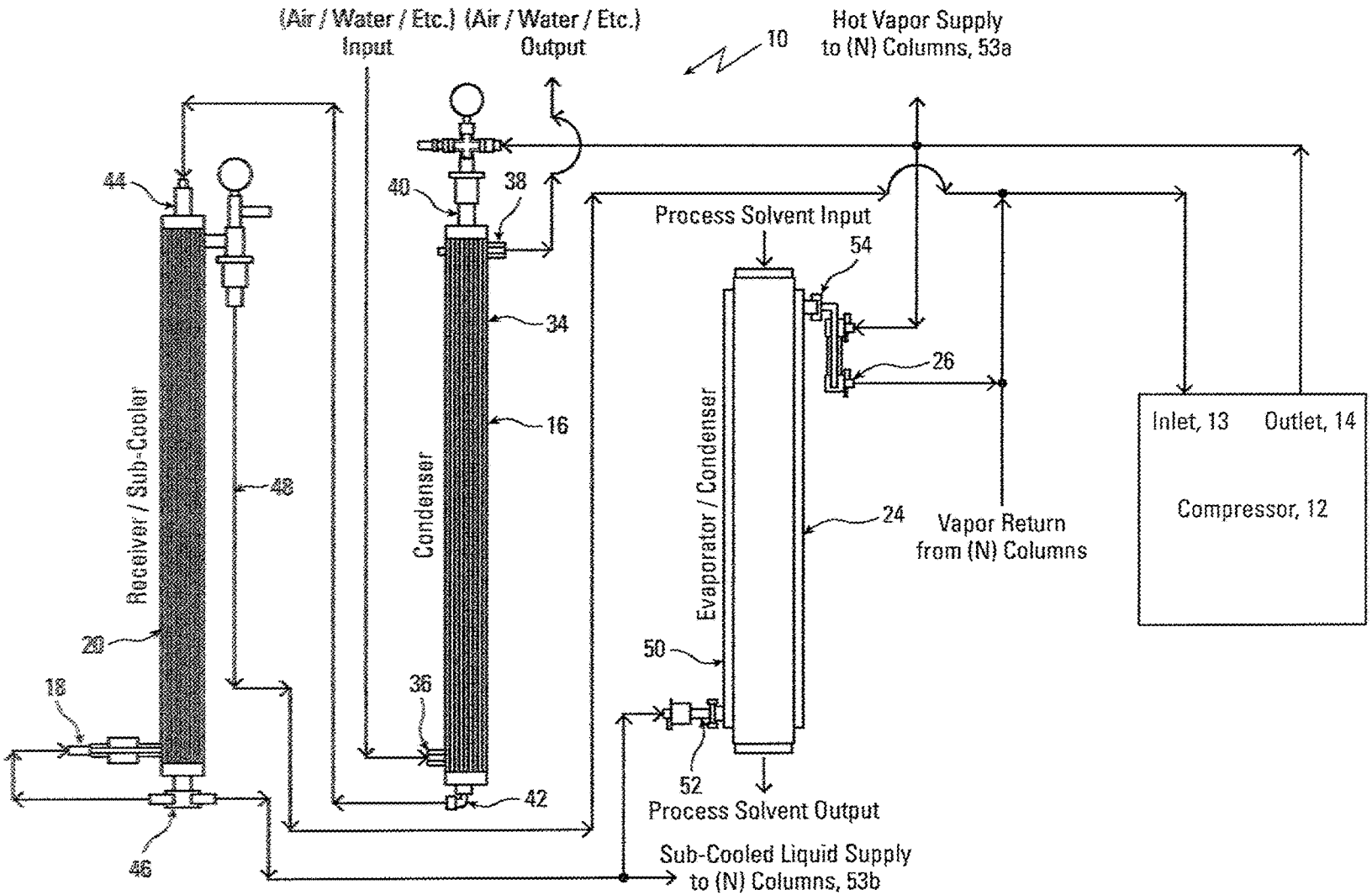
FIG. 2 is a schematic representation of an embodiment of a side view of the refrigeration apparatus illustrated in FIG. 1, hereof, showing the principal components in greater detail.

FIG. 2 is a schematic representation of an embodiment of a side view of refrigeration apparatus 10 illustrated in FIG. 1, hereof, showing the principal components in greater detail. Compressor 12, having low-pressure inlet 13 and high-pressure outlet 14, supplies superheated propane vapor to the core of condenser 16. Air, water, ethanol, another refrigerant, etc. are pumped through outer vanes, 34, of condenser 16 through inlet, 36, and outlet, 38, thereof to cool the superheated propane vapor disposed in the core, using pumps, refrigerators, and other apparatus suitable for this purpose, not shown in FIG. 2. An atmospheric heat exchanger, a small chiller for matching the heat introduced by the compressor, and the cold solvent after extraction, but before product recovery in a recovery basin have been used with success to condense the utility vapor. The superheated liquid propane is introduced into the core of condenser 16 through top or bottom fitting, 40, thereof, removed through the bottom or top fitting, 42, thereof after being cooled, and directed into the core of sub-cooler 20 through top fitting 44 thereof. As described above, cooled liquid propane exiting the core through bottom fitting, 46, is further cooled by introducing a portion of the liquid propane from the core of sub-cooler 20 into the shell portion thereof, and causing expansion of the liquid through expansion valve 18, which further cools the propane in the core. Vapor, 48, from the expansion is directed into inlet 13 of compressor 12.

A portion of cooled liquid propane exiting from the bottom of sub-cooler 20 through fitting 46 is directed into outer shell, 50, of at least one evaporator/condenser 24 through fitting, 52. Multiple columns (N) may be employed, for example, for extractions of plant oils, in both heated and cooled modes by utilizing manifolds, 53*a*, and 53*b*, respectively, for this purpose, as illustrated in FIG. 2. As stated, sub-cooled liquid refrigerant is directed into the shell of evaporator/condenser 24. This liquid can be further cooled by expansion through vapor removal valve 26 from which the vapor from all evaporator/condenser 24 employed, are returned to inlet 13 of compressor 12. If heating is desired for the columns, fitting, 54, is used to isolate evaporator/condenser 24 from the superheated vapor from outlet 14 of compressor 12.

In use, the temperature of the refrigerant entering sub-cooler 20 should be as close to or at the temperature of condensation at the experienced pressure, since the colder the solvent entering the sub-cooler, the less energy that will be required to maintain an exit temperature close to the temperature of evaporator 24.

Figure 3:
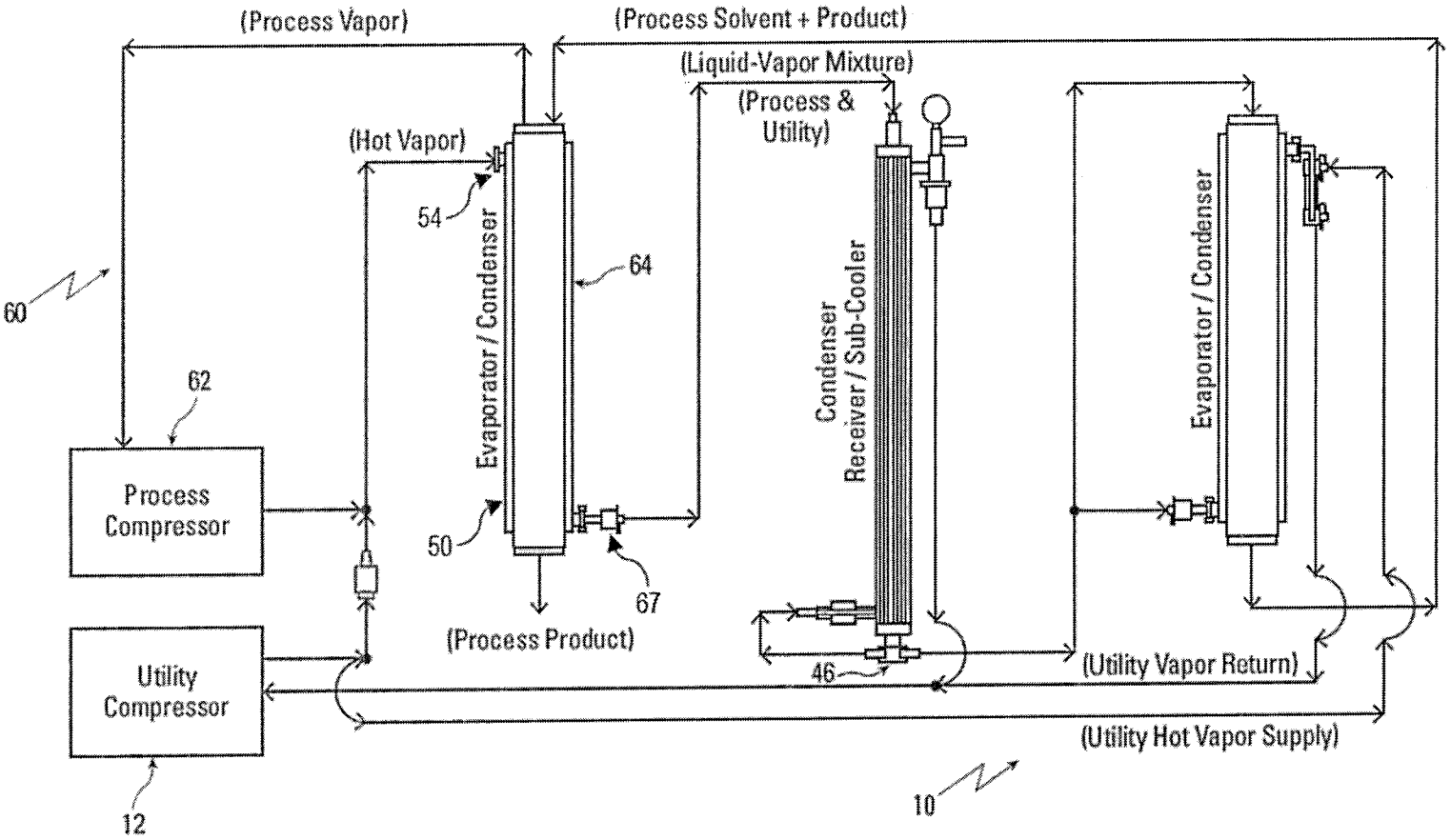
FIG. 3 is a schematic representation of a two-compressor embodiment of the present apparatus (extraction compressor and refrigeration compressor), where vapor from either compressor outlet may be directed into a vessel or device for vaporizing an extraction solvent contained therein, in either system the heat of compression being utilized for heating the extraction system without a secondary heating system. Cooling of the extraction system can be achieved using the refrigeration system.

FIG. 3 is a schematic representation of a two-compressor embodiment of the present apparatus (extraction compressor and refrigeration compressor), where vapor from either compressor outlet may be directed into a vessel or device for vaporizing an extraction solvent contained therein, such as in a collection basin, a wiped/rolled film evaporator, a rising/falling film evaporator, or a centrifugal evaporator, as examples. As described above, the heat of compression may be utilized for heating the extraction system without a secondary heating system. Utility (refrigeration) system 10 is shown as isolated from process system, 60, but both systems use the same condensed solvent, and each has its own compressor. This is the most efficient method of operation. Direction of flow into the columns may be from the top or bottom of the columns, with alternate arrangements being possible. Multiple (N) Evaporator-Condenser columns can be connected in parallel to absorb more heat in a similar manner to the multiple (N) columns. There is difference between (N) Evaporator-Condenser columns vs (N) Col. in that the latter has the capacity to both heat and cool the jackets while (N) Evaporator-Condenser columns only heat on the jackets.

Refrigeration/heating system 10 is described above, and utilizes compressor 12. Process system, 60, utilizes process compressor, 62, to heat at least one (N) extraction systems, 64, by directing hot vapor through fitting 54 into outer shell 50, and maintaining the pressure therein using valve, 67, or utility compressor 12 can cool at least one evaporator system 64, depending on the requirements of the extraction process. The extracted product would be separated from the solvent which would be returned to refrigeration system 10.

Figure 4C:
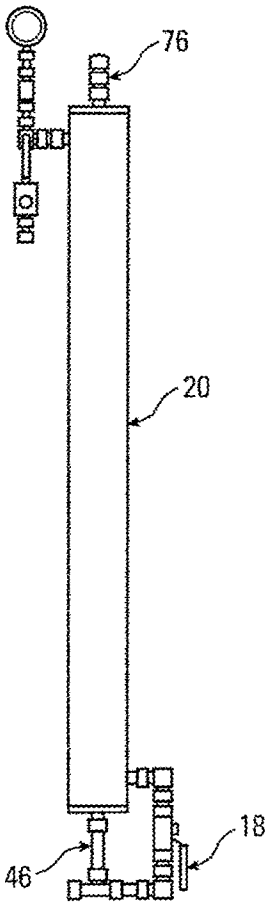
FIG. 4C is a schematic representation of a side view of the sub-cooler shown in FIG. 2 hereof.
Figure 4B:
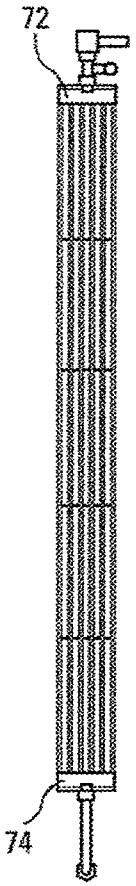
FIG. 4B is a schematic representation of a side cutaway of the sub-cooler shown in FIG. 2, hereof.
Figure 4A:
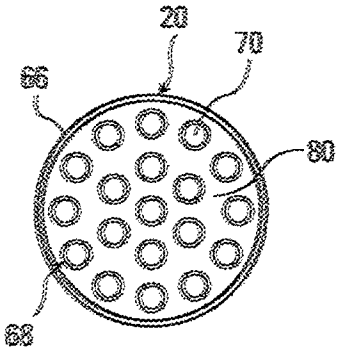
FIG. 4A is a schematic representation of an embodiment of a bottom view of the sub-cooler shown in FIG. 2, hereof.

As stated above, refrigerant flows into the top of the sub-cooling condenser and into the core thereof. The liquid then exits from the bottom of sub-cooler whereby outlet 46 delivers a portion of the core liquid, which may be a sub-cooled liquid, to thermally controlled areas, such as the extraction columns or vessels being chilled, and valve, 78, entering jacket 66 of the sub-cooling condenser permits the liquid from the inside the core tubes to enter jacket 66 surrounding the core tubes. A simple fitting at the outlet is in fluid contact with inlet 13 of compressor 12, typically first entering a liquid-vapor separator or oil separator to prevent liquid from entering compressor 12, not shown in FIG. 4. From outlet 14 of compressor 12 vapor heated from the compression returns to the high-pressure vapor supply before passing through pressure fitting 40 as it enters first condenser 16, thereby forming a loop. Solvent injected into the extraction column(s), or vessels being chilled, exits as a vapor and joins the vapor from the sub-cooling condenser jacket outlet before entering the compressor. The pressure of the vapor within the jacket/columns determines the refrigerant temperature since it generates a saturated liquid-vapor mixture. This property lowers the temperature of the remaining liquid, which then becomes the source of thermal absorption. By injecting a sub-cooled liquid, the injection does not add heat to the column and enables the liquid level to be maintained without gaining pressure and thereby heat.

Under vacuum, the temperature of a liquid refrigerant decreases rapidly with a small decrease in pressure. Further, the amount of heat absorbed when compared to the amount of vapor generated are greatly different when operating under vacuum vs positive pressure. The lower the evaporation pressure, the less power is required to recompress the refrigerant. Assuming R290 (propane) as a refrigerant, at an inlet pressure of −10 psi gauge pressure (−65° C.), the compressor employed uses 3.2 hp or 10 A @ 220 V, and can move 0.45 lb. of vapor per minute. By contrast, at an inlet pressure of +10 psi gauge pressure (−30° C.), the compressor employed uses 6.2 hp or 20 A @220 V, and can move 3 lb. of vapor per minute. Working under vacuum is not required for operation embodiments of the present apparatus, but a significant increase of efficiency of the over the previously described apparatus has been observed.

Figure 5:
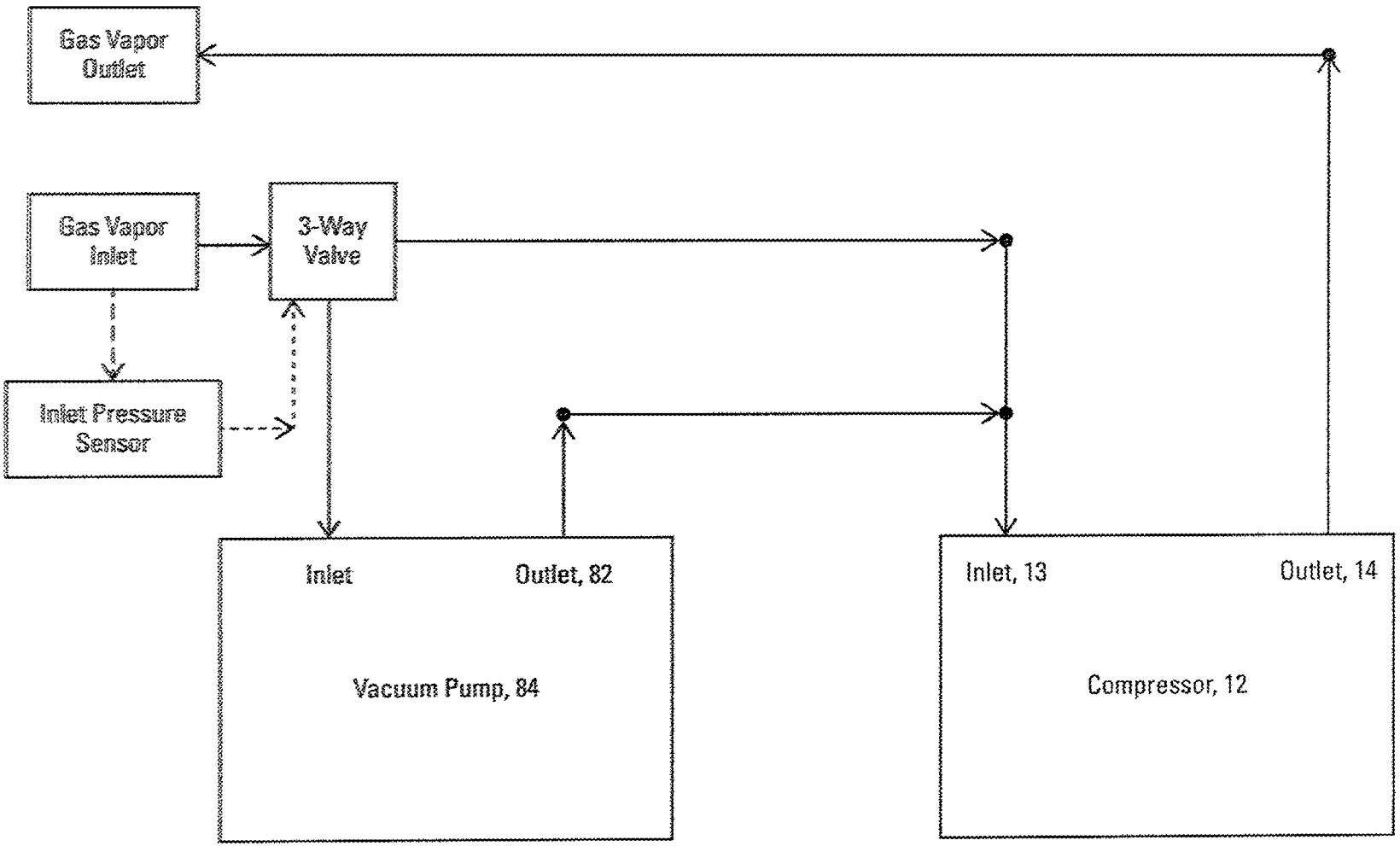
FIG. 5 is a schematic representation of an atmospheric pressure compressor having its inlet augmented using the outlet of a vacuum pump. As stated, once the refrigerant is at or below zero psi, the change in temperature vs. pressure is different than that of the temperature vs. pressure for a positive pressure refrigerant.

FIG. 5 is a schematic representation of an atmospheric pressure compressor 12 having its inlet 13 augmented using outlet, 82, of vacuum pump, 84. As stated, once the refrigerant is at or below zero psi, the change in temperature vs. pressure is different than that of the temperature vs pressure for a positive pressure refrigerant. For example between about 0 and about 350 psi, there is a 114° C. increase in heat, while between about 0 psi and about −14.7 psi, there is a 106° C. decrease in heat. Under positive pressure conditions, every psi gauge only increases the heat by about 3° C., while under negative pressure conditions, every psi gauge decreases the heat by about 7.21° C. Thus, more than double the amount of heat is lost per psi pressure removed under negative pressure (gauge) conditions when compared to a positive pressure (gauge). As an absolute pressure, the optimum refrigeration condition would be experienced between about 0 and about 14.7 psia. The difference between gauge pressure and absolute pressure is that gauge pressure has the pressure of sea level removed from its reading: therefore, 0 psig=14.7 psia.

Thus, once the system is below zero psi it can remove more than twice the amount of heat per psi that it could otherwise remove under positive pressure. The total amount of heat that can be absorbed beyond the baseline sub-cooled liquid, is related to the level of vacuum of the system. It is anticipated by the inventor, that a true cryogenic system (−150° C.) can be generated using a single-stage refrigeration system. Traditionally, a cascade refrigeration system is required to cool below −60° C., where a cascade system is comprises multiple compressors using different refrigerants, where each system works on the next system in order to reduce the end point temperature. With cascade systems, there is a large power consumption requirement, and such systems are limited by the amount of vapor that passes through the compressor.

As stated, embodiments of the present apparatus use about 10 amps at −50° C., and less power as the temperature drops, and is not regulated by the amount of vapor which passes through the compressor. Embodiments of the present method of refrigeration expands on the first law of thermodynamics, where the system should require more power the colder it gets; however, this assumes no additional enthalpy is removed post condensation. With both calculations and direct observation, it has been confirmed that the system uses less power the lower the pressure becomes/the colder the system gets.

Finally, embodiments of the present invention do not rely on the volume of vapor that moves through the compressor as with the traditional methods. A small amount of vapor moves through the compressor while a very large volume of liquid provides cooling ability within the system. Reliance is instead on the volume of liquid refrigerant that is at or below zero psi gauge. By reintroducing refrigerant at or near the temperature of evaporation, the operating pressure does not increase upon injection of liquid into the second evaporator, and thereby does not increase the amount of work by the compressor.

Liquid refrigerant with heat removed will remain cold for a very long time. Only vapor above the liquid needs to be removed to force all of the remaining liquid to become the temperature set by the pressure of its vapor.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A device heating and cooling system, comprising:

a compressor for generating superheated vapor from a first refrigerant;

a condenser for receiving superheated vapor, for removing heat from the superheated vapor, and for generating a liquid refrigerant therefrom; and at least one sub-cooler, comprising:

a first chamber having a first outer surface, a top and a bottom, enclosing a core volume for receiving the liquid refrigerant;

a second chamber extending radially beyond and enclosing the first outer surface of said first chamber, and in thermal communication therewith, having a second outer surface, a top and a bottom, forming a second volume;

a fitting in fluid communication with the core volume;

an expansion valve for receiving liquid refrigerant from said fitting and for expanding a portion of the liquid refrigerant into the second volume, whereby the liquid refrigerant in the second volume is cooled, thereby cooling the liquid refrigerant in the core volume, with refrigerant vapor generated by said expansion valve being directed to said compressor; and a first manifold for directing the liquid refrigerant in the core volume through said fitting to devices to be cooled.

2. The device heating and cooling system of claim 1, whereby a chosen volume of first refrigerant from the second volume is vaporized into the inlet of said compressor, such that the first refrigerant in the core volume is cooled, said device heating and cooling system further comprising a second manifold for directing the superheated vapor into the devices to be heated.

3. The device heating and cooling system of claim 1, wherein said first refrigerant comprises a hydrocarbon refrigerant.

4. The device heating and cooling system of claim 3, wherein said hydrocarbon refrigerant is chosen from propane, butane, and isobutane, or mixtures thereof.

5. The device heating and cooling system of claim 1, further comprising a vacuum pump for reducing inlet operating pressure of said compressor such that cryogenic hydrocarbon temperatures can be utilized.

6. The device heating and cooling system of claim 1, wherein heat is removed from the superheated vapor in said condenser by cooling said condenser with a second refrigerant selected from air, water and ethanol, or combinations thereof.

7. The device heating and cooling system of claim 1, further comprising a liquid-vapor separator for preventing condensate from entering said compressor.

8. A method for heating and cooling devices, comprising:

generating superheated vapor by compressing a first refrigerant;

removing heat from the superheated vapor, whereby a liquid refrigerant is generated therefrom; and filling the core volume having an outer surface of a chamber with the liquid refrigerant;

filling a second volume of a chamber extending radially beyond and enclosing the outer surface of the core volume and in thermal communication therewith with the liquid refrigerant;

vaporizing the liquid refrigerant in the second volume of the chamber into an inlet of a compressor, whereby the liquid refrigerant in the core volume is cooled; and directing the liquid refrigerant that has been cooled in the core volume to devices to be cooled.

9. The method for heating and cooling devices of claim 8, further comprising the steps of removing a chosen volume of the first refrigerant from the second volume and vaporizing the first refrigerant into the inlet of the compressor, whereby the first refrigerant in the core volume is cooled; and directing the superheated vapor into devices to be heated.

10. The method for heating and cooling devices of claim 8, wherein said first refrigerant comprises a hydrocarbon refrigerant.

11. The method for heating and cooling devices of claim 10, wherein said hydrocarbon refrigerant is chosen from propane, butane, and isobutane, or mixtures thereof.

12. The method for heating and cooling devices of claim 8, further comprising the step of reducing an inlet operating pressure for said step of generating superheated vapor by compressing the first refrigerant such that cryogenic hydrocarbon temperatures can be utilized.

13. The method for heating and cooling devices of claim 8, wherein said step of removing heat from the superheated vapor, whereby the liquid refrigerant is generated therefrom, further comprises cooling said condenser with a second refrigerant selected from air, water and ethanol, or combinations thereof.

14. The method for heating and cooling devices of claim 8, further comprising the step of preventing condensate from being compressed during said step of compressing the refrigerant by using a liquid-vapor separator.

15. A device heating system, comprising:

a compressor for generating superheated vapor from a first refrigerant; and at least one evaporator/condenser, comprising:

a first chamber having a first outer surface, a top and a bottom, enclosing a core volume for receiving an extraction solvent to be heated;

a second chamber extending radially beyond and enclosing the first outer surface of said first chamber, and in thermal communication therewith, having a second outer surface, a top and a bottom, forming a second volume;

a fitting in fluid communication with the second volume for filling the second volume with super-heated vapor of said first refrigerant from said compressor at a pressure; and a valve in fluid communication with the second volume for maintaining the pressure;

whereby the extraction solvent is heated.

16. The device heating system of claim 15, further comprising a manifold for directing the superheated vapor into the devices to be heated.

17. The device heating system of claim 15, wherein said first refrigerant comprises a hydrocarbon refrigerant.

18. The device heating system of claim 17, wherein said hydrocarbon refrigerant is chosen from propane, butane, and isobutane, or mixtures thereof.

* * * * *